362-110

7/20/82 XR 4,340,930 SR

United States Patent [19]

Carissimi

[11] 4,340,930

[45] Jul. 20, 1982

[54] LIGHT ASSEMBLY FOR ARCHERS ARROW

[76] Inventor: Sam Carissimi, 22731 Sunnyside, St. Clair Shores, Mich. 48080

[21] Appl. No.: 182,491

[22] Filed: Aug. 29, 1980

[51] Int. Cl.[3] ..... F21L 7/00

[52] U.S. Cl. ..... 362/204; 362/110; 362/205; 273/416

[58] Field of Search ..... 273/106.5 R; 362/110, 362/204, 205

[56] References Cited

U.S. PATENT DOCUMENTS 4,220,983 9/1980 Schroeder ..... 362/110

*Primary Examiner*—Stephen J. Lechert, Jr.
*Attorney, Agent, or Firm*—Cullen, Sloman, Cantor, Grauer, Scott & Rutherford

[57] ABSTRACT

An archers arrow having a body, a head, fletching and a nock, has a bore in the body adjacent the fletching. A sleeve on the nock is secured within the body, and mounts on its interior a normally open electrical circuit including a lamp and a battery assembly, with the lamp nested within the nock, and the nock being of a light transmitting plastic material. A manual switch is movable on the body to close the circuit.

12 Claims, 3 Drawing Figures

LIGHT ASSEMBLY FOR ARCHERS ARROW

BACKGROUND OF THE INVENTION

Absent direct visual contact with the impact point of an arrow there is long existed the difficulty of retrieving the arrow in the dusk or after darkness. Heretofore, having direct visual contact with the impact point of an arrow which has hit its mark and particularly in the case of a deer or other animal wounded fatally or non-fatally, there has long been the problem of locating the animal after dusk or in darkness. Heretofore, animals such as a deer or other animal which has been non-fatally struck by an arrow, will normally within a short period break off a portion of the arrow and travel in the woods a distance before falling. There has long existed the problem of locating the animal at some point beyond the point of impact.

THE PRIOR ART

According to the U.S. Pat. No. 3,790,948 of February 1974 granted to John M. Ratkovitch, there is disclosed the use of a radio transmitter in the tip of a hunting arrow having an antenna carried on the shank for use in conjunction with a direction finding receiver carried by the hunter.

U.S. Pat. No. 1,890,841 of December 1932 issued to R. D. Brown, disclosed an illuminated knife.

U.S. Pat. No. 3,361,066 January 1968 issued to H. Gawlick, et al, discloses a tracer bullet that is ignited upon impact.

U.S. Pat. No. 2,965,029 dated December 1960 issued to L. D. Jackson, discloses a marine marker that disperses die for location identification.

U.S. Pat. No. 2,908,101 of Oct. 13, 1959 issued to Fay J. Butler is directed to an illuminated fishing float.

U.S. Pat. No. 3,041,771 of July 3, 1962 issued to Michael Hreno is directed to an illuminated fishing bobber.

U.S. Pat. No. 4,106,079 of August 1978 and issued to Lynn Drury is directed to an illuminated drum stick or baton.

U.S. Pat. No. 3,351,723 of November 1967 and issued to Ming et al discloses a pocket flashlight having a batter, incandescent lamp and an electric switch connected together in series.

These patents were revealed in a search of the Patent Office records conducted in the following areas:

Class 43, subclasses 6 and 17.5; Class 102, subclass 87; Class 116, subclasses 202, 203 and 209; Class 124, subclass 22; Class 200, subclass 60; Class 250, subclasses 483, 484, 485, 486, 487, 488 and 489; Class 273, subclasses 416, 417, 418, 419, 420, 421, 422 and 423; and Class 362, subclasses 34, 84, 113, 114, 115, 116, 117, 118 and 119.

SUMMARY OF THE INVENTION

An important feature of the present invention is to incorporate within body of the arrow a normally open electrical circuit which includes a lamp and a battery assembly together with a manual switch on the body adapted to close said circuit.

A further feature is to provide a power operated light source within an archers arrow by which absent direct visual contact of the impact point thereof the lighting of the arrow or a portion thereof will facilitate the user's location of such arrow in dusk or nightfall or in dark or poorly lighted areas.

A further feature includes a hunter's arrow with an elongated body having a bore therein adjacent the fletching thereof and wherein a transparent sleeve arranged on one end of the nock is projected into and secured within said body within the bore wherein the nock is constructed of a light transmitting plastic material having a bore therein adjacent one end. A normally open electrical circuit includes a lamp and a battery assembly nested within said sleeve and body and with the lamp positioned within the nock.

A further feature provides a sub-assembly which includes a tubular insulator having a pair of insulated conductors therein at their one end adapted for connection to the respective contacts of a lamp, with one of the other ends of said conductors connected to the contact on a battery projected within said insulating sleeve and wherein the other end of the other conductor terminates in a switch normally spaced from another contact of the battery. Said circuit provides a unit assembly normally nested within the nock mounted sleeve and wherein the nock and sleeve in such unit assembly are projected as a unit into the bore of said arrow. A further object is to provide in the electrical circuit either an incandescent lighting source energized by said battery or a florescent lamp such as a neon lamp together with sufficient electrical components within the circuit to provide the proper current and voltage for energizing such lamp.

These and other objects will be seen from the following specification and claims in conjunction with the appended drawing.

THE DRAWING

It will be understood that the above drawing illustrates merely a preferred embodiment of the invention, and that other embodiments are contemplated within the scope of the claims hereafter set forth.

DETAILED DESCRIPTION OF AN EMBODIMENT OF THE INVENTION

Figure 1:
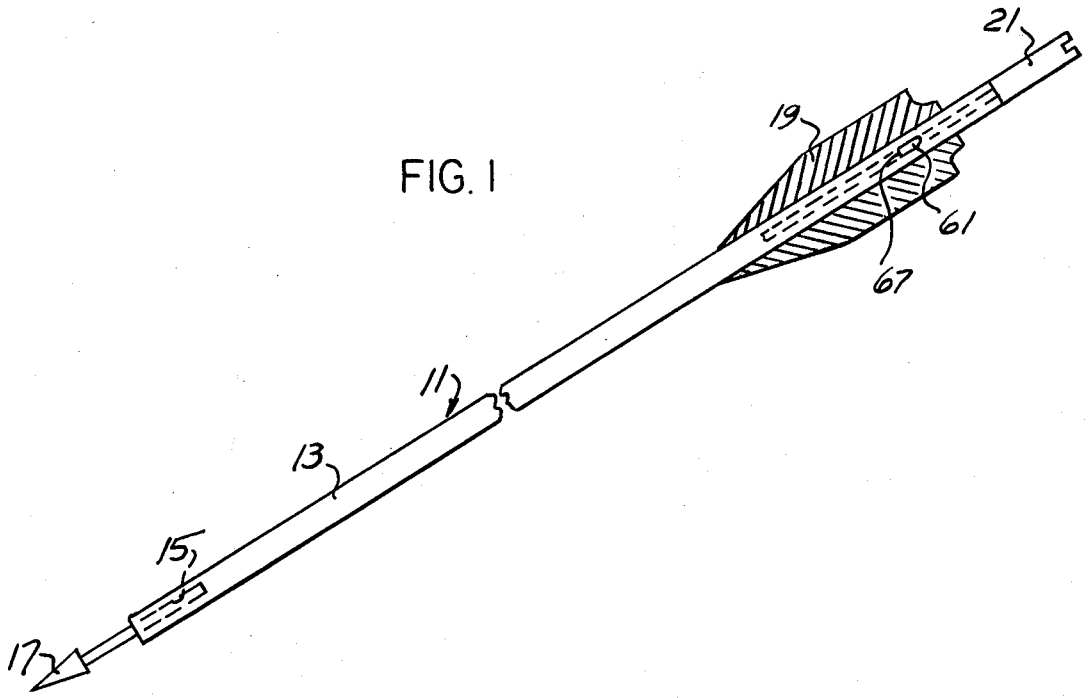
FIG. 1 is a fragmentary perspective view of the present archers arrow having an illuminating means incorporated thereinto.

Referring to the drawing a hunters arrow is fragmentarily shown at 11 in FIG. 1 and includes an elongated body 13, which may be constructed of fibre glass or alternatively of a light transmitting plastic material in whole or part. In the illustrative embodiment the body has an elongated bore 15, and at one end a conventional arrow head 17.

A conventional fletching 19, tri-part in construction, is applied to and extends radially outward of the body adjacent the rear end thereof and forwardly of the nock 21. Said nock is preferably constructed of plastic such as a translucent plastic which is light transmitting or is suitable nylon or other plastic material.

In the illustrative embodiment the nock 21 is separable from body 13 and upon one end thereof has connected thereto elongated plastic transparent sleeve 23. Said sleeve is adapted for snug projection and securing within an end portion of said body. The nock adjacent one end at its connection with the sleeve 23 has therein an axial bore 25 or recess adapted to receive a lamp 27 having a filament 29 or alternatively the lamp 27 may be of a florescent type such as a neon tube having the conventional florescent coating and electrical assembly generally indicated at 29.

Figure 3:
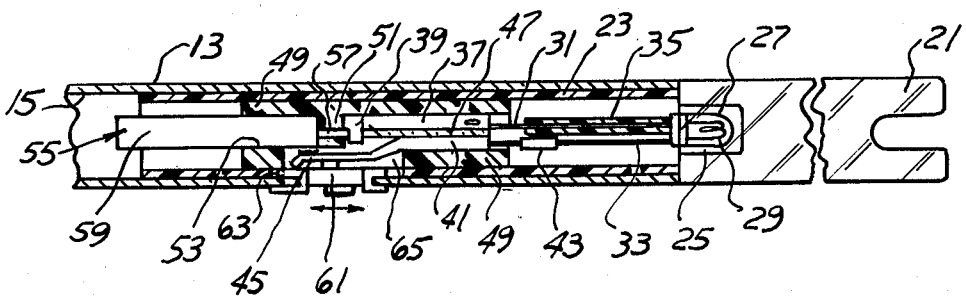
FIG. 3 is a similar fragmentary section on an increased scale for clarity.

The lamp, regardless of its type includes a pair of elongated leads 31 and 33, there being a suitable insulator sleeve 35 surrounding lead 31 with one end of lead 31 connected to an elongated conductor 37 FIG. 3, which terminates in the contact 39.

The other lead 33 joins an intermediate electrical component 43 which forms a part of an electrical circuit. Component 43 terminates in the conductor 41 having at its end switch contact 45. A ceramic or other insulator 47 is interposed between conductors 37 and 41. Elongated insulating sleeve 49, preferably of a ceramic material, receives toward one end thereof an assembly which includes conductors 37 and 41 and the intermediate insulator 47. Sleeve 49 has an apertured flange 51 intermediate its ends.

The switch contact 45 is nested with an outwardly opening slot 65 within insulator sleeve 49. A suitable battery 55, cylindrical in form, such as a 2.8 voltage Lithium battery in the case of an incandescent lamp, has an axial contact pin 57 at one end which is projected through the bore of flange 51 in said insulator, and in the assembled position shown is in engagement with contact 39. Said battery at one end is snugly projected within the bore 53 of the insulator sleeve 49, and in the position shown its outer contact surface 59 is normally spaced from flexible switch contact 45.

The switch arm 61 having slotted support portions 63 at its opposite ends, is nested within a lateral aperture 67 within body 13 and extends into the adjacent slot 65 formed within insulator 49 and is normally in engagement with switch contact 45.

The circuit between the battery and the lamp and the respective conductors 37 and 41 is completed by a manual longitudinal adjustment of the switch arm 61 upon the arrow body 13 such that switch arm moves the switch contact 45 into engagement with contact 59 of the battery.

The lateral aperture 67 within the arrow body 13 shown in FIG. 1 as adjacent the fletching 19 and is conveniently located thereon for limited longitudinal adjustment of switch arm 61 for closing the electrical circuit, just before the arrow is released from the conventional bow.

In the illustrative embodiment, the elongated transparent sleeve 23 which is connected to the nock 21 is frictionally projected into or otherwise secured and retained within the bore 15. In the illustrative embodiment said sleeve is of reduced diameter with respect to the diameter of the nock so that upon assembly of the nock and the sleeve 23 within bore 15, the nock is in end to end engagement with the arrow body and forms a smooth continuation thereof, in FIG. 3.

Broadly defined, a normally open electrical circuit including a lamp 27 and a battery assembly with electrical connections is nested within the sleeve 23 and the body 13 and the lamp 27 is nested within the bore 25 in nock 21. Accordingly the manual switch means 61 is in the form of a switch arm guidably mounted upon the body and within an aperture 67 therein, adapted for limited longitudinal movement sufficient to close the normally opened circuit energizing the lamp.

In the illustrative embodiment illumination from the lamp is transmitted to the exterior of the arrow body by the light transmitting plastic material forming the nock 21. As above set forth, portions of the body 13 of the arrow adjacent the nock and light source may also be of a light transmitting plastic material further transmitting light from the light source. The entire body 13 may be constructed of a plastic light transmitting material.

In the event that a neon lamp is used as at 27, then in that case the electrical circuit will include such sufficient power transmitter means as will energize the florescent or neon lamp.

In the event that a florescent or neon lamp 27 is employed adapted to be energized by a suitable battery 55 of sufficient power, there would be incorporated into the electrical circuit a conventional choke or starter and inductor and wherein the power transmitting means schematically shown at 43–29 includes an invertor circuit raising battery voltage modifying the current to AC current of sufficient power to initially activate the choke or starter in the circuit and interconnected into the main circuit for the florescent lamp 27 energizing the same, all on a conventional manner.

Since the circuitry involved for the electrical power activation of a florescent or neon lamp is conventional, further detailed explanation thereof is omitted.

In the illustrative embodiment the electrical circuit per-se includes lamp 27 with its leads 31 and 33 in insulated relation, at their respective ends connected to the adjacent ends of the conductors 37 and 41 insulated at 47 therebetween, and with said conductors nested within an insulator sleeve 49. The insulator sleeve has a bore 53 and snugly and removably receives an inner end portion of the battery 55 with one contact 57 in registry with contact 39 on conductor 37. The other conductor 41 has a switch contact 45 normally nested within an outwardly opening aperture 65 in the insulator sleeve 49 and normally spaced from the secondary contact surface 59 of the battery.

Figure 2:
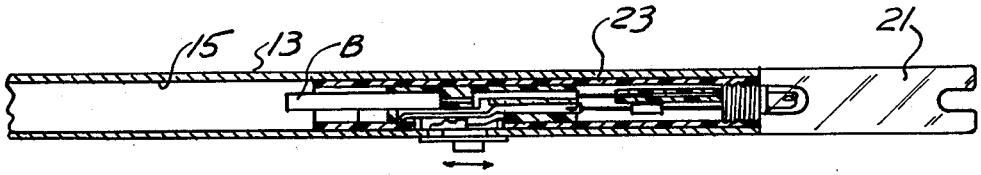
FIG. 2 is a fragmentary longitudinal section of rear portions of the arrow body mounting therein the electrical circuit including the battery, lighting means and electrical connections therefor, being substantially full scale.

This complete assembly as a unit is projected into the nock mounted sleeve 23 so that the lamp 27 is positioned and nested within the nock bore 25. So assembled as a unit, nock and the connected sleeve 23 are projected snugly and frictionally into the bore 15 of the arrow body assuming the relative position of the parts shown in FIGS. 1, 2 and 3. At this time the electrical circuit is normally open and is closed on manual movement of the switch arm 61 from the position shown in FIG. 3 in a direction towards the head 17 sufficient to move the contact 45 into engagement with the battery contact 59.

One form of electrical switch means is described in the foregoing Specification as a manual switch upon the body of the arrow, it is contemplated that other switches could also function to accomplish the same result. For example a switch may be a mercury switch, a magnetic switch, or an inertia switch capable of closing the electrical circuit to the power source as desired.

Another form of electrical switch means may include a photo electric cell normally maintaining the circuit open during daylight. Under reduced daylight conditions including dusk, the switch automatically closes to energize the light circuit.

Another form of electrical switch means includes the use of a remote radio signal to activate a receiver switch on the arrow to close such circuit.

Having described my invention reference should now be had to the following claims.

I claim:

1. In an archers arrow having an elongated body, a head, fletching and a nock;

there being a bore in said body adjacent said fletching;

a sleeve on one end of and aligned with said nock, frictionally projected into said body within said bore;

said nock being of a light transmitting plastic material and having a bore adjacent its one end;

a normally open electrical circuit including a lamp and a battery assembly nested within said sleeve and body, with said lamp positioned within said nock bore;

and a switch means on said arrow adapted to close said circuit.

2. In the arrow of claim 1, said sleeve being of a reduced diameter relative to said nock;

said nock bearing against one end of said body as a smooth continuation thereof.

3. In the arrow of claim 1, said sleeve and adjacent portions of said body being of a plastic light transmitting material.

4. In the arrow of claim 1, said lamp being incandescent.

5. In the arrow of claim 1, said lamp being a neon lamp, said battery asembly including power tranmitting means to energize said lamp.

6. In the arrow of claim 1, said circuit including an elongated insulating sleeve frictionally nested within said nock sleeve;

a pair of parallel spaced insulated conductors mounted in said insulating sleeve, at their one ends connected to the respective leads of said lamp;

one of said conductors at its other end being connected to said battery, the other of said conductors at its other end terminating in a normally open switch spaced from said battery;

said manual switch means engaging said normally open switch, and on longitudinal movement in one direction adapted to close said switch and circuit.

7. In the arrow of claim 6, said battery at one end being frictionally projected into one end of said insulating sleeve.

8. In the arrow of claim 1, said battery being a 2.8 volt Lithium battery.

9. In the arrow of claim 5, said circuit including and inductor and a starter;

said power transmitting means including an invertor circuit.

10. In the arrow of claim 7, said insulating sleeve, said lamp and said battery forming a unit assembly nested within said nock sleeve, with said lamp nested within said nock;

said nock adapted for projection as a unit within said arrow bore.

11. In the arrow of claim 1, a normally open switch in said circuit having a contact spaced from said battery;

there being registering apertures in said body and insulating sleeve outwardly of said switch;

said manual switch means normally engaging said normally open switch and on limited longitudinal movement in one direction adapted to move said switch contact to engage said battery.

12. In the arrow of claim 1, the switch means being a manual switch on said arrow body.

* * * * *